US011266565B2

(12) United States Patent
Kao

(10) Patent No.: US 11,266,565 B2
(45) Date of Patent: Mar. 8, 2022

(54) IMPACT MASSAGER

(71) Applicant: Jui-Hung Kao, Taipei (TW)

(72) Inventor: Jui-Hung Kao, Taipei (TW)

( * ) Notice: Subject to any disclaimer, the term of this patent is extended or adjusted under 35 U.S.C. 154(b) by 290 days.

(21) Appl. No.: 16/565,491

(22) Filed: Sep. 10, 2019

(65) Prior Publication Data

US 2020/0000678 A1 Jan. 2, 2020

Related U.S. Application Data

(63) Continuation-in-part of application No. 15/063,517, filed on Mar. 8, 2016, now abandoned.

(30) Foreign Application Priority Data

Sep. 23, 2015 (CN) ..... 201510611608.2

(51) Int. Cl.
*A61H 23/02* (2006.01)
*A61H 23/00* (2006.01)

(52) U.S. Cl.
CPC ..... *A61H 23/0218* (2013.01); *A61H 23/006* (2013.01); *A61H 2201/0157* (2013.01)

(58) Field of Classification Search
CPC ..... A61H 23/0218; A61H 23/006; A61H 2201/0157; A61H 2205/081; A61H 2201/5082; A61H 2201/5025; A61H 2201/0153; A61H 2201/1628; A61H 2201/1664; A61H 1/008; A61H 2201/0165; A61H 2201/1207; A61H 2201/5023; A61H 1/00; A61H 23/02; A61H 2201/12–1246; A61H 2201/14–149
USPC ..... 601/97, 101, 103, 107, 111; 606/237, 606/238, 239
See application file for complete search history.

(56) References Cited

U.S. PATENT DOCUMENTS 4,549,535 A * 10/1985 Wing ..... A61H 23/0218 310/35
6,663,657 B1 * 12/2003 Miller ..... A61H 23/008 601/107
7,144,417 B2 * 12/2006 Colloca ..... A61H 1/008 606/239
8,096,963 B2 * 1/2012 Murugan ..... A61H 1/008 601/97
9,980,870 B2 * 5/2018 Jacobs ..... A61H 1/008
(Continued)

FOREIGN PATENT DOCUMENTS

TW 201440753 * 6/2014 ..... A61H 23/02

*Primary Examiner* — Timothy A Stanis
*Assistant Examiner* — Benjamin M. Kusiak

(57) ABSTRACT

An improved impact massager includes two impact force modules and a main circuit board in a chassis. An electromagnetic component and a cushioning element are coaxially provided in a heat sink of each impact force module. A drive rod of a drive component group is connected to an impact rod. A coupler of a transmission assembly is connected to the coupling seat with an oscillating coil provided therein and electrically connected with the main circuit board. When the oscillating coil and the magnetic core ring are coaxially positioned and displaced with respect to each other, the magnetic core ring does not interact with the oscillating coil, no current is generated by the oscillating coil and the main circuit board is in a power-off state, such that no power is transmitted to the electromagnetic component and motions are inhibited under no-load condition.

10 Claims, 8 Drawing Sheets

(56) References Cited

U.S. PATENT DOCUMENTS

| | | | | |
|---|---|---|---|---|
| 2002/0082532 | A1* | 6/2002 | Tucek | A61H 1/008 601/97 |
| 2003/0195443 | A1* | 10/2003 | Miller | A61H 1/008 601/108 |
| 2006/0047315 | A1* | 3/2006 | Colloca | H01F 7/1607 606/239 |
| 2007/0150004 | A1* | 6/2007 | Colloca | A61H 1/008 606/238 |
| 2010/0137907 | A1* | 6/2010 | Tsai | A61H 23/00 606/238 |
| 2010/0331745 | A1* | 12/2010 | Yao | A61H 23/06 601/101 |
| 2011/0245740 | A1* | 10/2011 | Novak | A61B 17/225 601/107 |
| 2014/0188169 | A1* | 7/2014 | Jacobs | A61H 1/008 606/239 |
| 2015/0005682 | A1* | 1/2015 | Danby | A61H 23/0254 601/101 |
| 2019/0159961 | A1* | 5/2019 | Chuang | A61H 23/006 |
| 2020/0113777 | A1* | 4/2020 | Novak | A61H 23/04 |

* cited by examiner

IMPACT MASSAGER

BACKGROUND OF THE INVENTION

This invention relates generally to an improved impact massager, and more particularly to an improved impact massager that can provide back buffer and no-load protection.

A small massager traditionally achieves vibrating massage effect by using a motor with an eccentric load to generate high-speed (over 60 times per second) rotational motions or by applying high-speed (over 60 times per second) electromagnetic vibrations to generate reciprocating motions. Such motions, however, may only massage and soothe the skin surface or shallow muscle groups around an aching spot. In actual practice, to eliminate pain and soreness, the massager must provide low-speed (2~12 times per second) regular impact toward meridian points, local deep muscle groups, spine, joints, or soft tissue.

In the current market, small (handheld) massagers have structures such as the one disclosed in TW patent publication No. M446632 titled "Massager with Improved Structure". In this publication, an outer chassis is provided with an upper sleeve. Inside the upper sleeve, an electromagnetic component is formed by a coil wound around a central conductor. A drive component group has a drive rod that extends into the central conductor and is driven by electromagnetic effect. One end of the drive rod is coupled to a fitting, while the other side of the drive rod is sleeved into a spring through an upper linkage. A limiter is further provided on an end of the upper linkage. A transmission assembly includes a lower sleeve connected to the upper sleeve. The lower sleeve has a center hole for containing the fitting. One end of a transmission rod extends inside the center hole to abut against the fitting. The mid-section of the transmission rod has an axially extending concave guide groove. The periphery of the lower sleeve has a transversely disposed guide pin extending into the center hole and the guide grove in order to guide the transmission rod in a sliding manner. A fastener is coupled to an end of the transmission rod away from the fitting, and it is equipped with a coupling portion thereon to combine with an impact head. As such, reciprocating massaging motions can be achieved by driving the impact head from the electromagnetic component through the drive component group, the transmission assembly and the fastener.

Structures like the aforementioned and other similar structures cannot be configured to apply low-speed regular linear-motion impact of different forces or frequencies at the same time. Therefore, they fail to satisfy the need to apply low-speed, regular linear-motion impact toward meridian points, local deep muscle groups, spine, joints, or soft tissue.

Furthermore, in TW patent publication No. 1494100 titled "Differential Frequency Impact Massager", a chassis is provided with a housing space, wherein one end of the housing space is connected to the outside through two openings. Two impact force modules are provided inside the housing space, each partially extends through the two openings to extend outside of the chassis, and each connects to an impact head. The massager also includes a control assembly consisting of a main circuit board, an operational switch with three states of operation, and a control panel and connected with the two impact force modules. A plurality of adjustment units are disposed on the control panel. Each adjustment unit is linked with an adjustment knob outside of the chassis. A side of the chassis extends to form a grip portion configured with the operational switch having the three states of operation. By adjusting the adjustment knobs, the adjustment units can provide different levels of controlled adjustments so that the main circuit board can control the two impact force modules to create linear regular impacts with different forces and frequencies.

Although the above publication provides low-speed linear regular impact massaging motions with different levels of forces and frequencies at the same time, there are, nonetheless, the following shortcomings to be addressed:

The impact force modules lack no-load protection and additional buffering mechanism during impact. Thus, when returning backwards, the impact force created may result in strong vibrations of the impact force modules, which may cause violent shaking of the entire massager or even damage to the mechanical elements due to friction. Meanwhile, for such a differential frequency impact massager, if the switch is inadvertently pressed before the impact head comes into contact with a human body, the impact force modules will create continuous impacts, and since the impact head does not experience any counter forces, the impact force modules will remain in this current condition, during which the electromagnetic coils inside the impact force modules may become overheated and damaged. This may even cause damage to the user's body.

In light of the above drawbacks, the embodiments of the present invention provide an improved impact massager.

BRIEF SUMMARY OF THE INVENTION

An objective of the present invention is to provide an improved impact massager equipped with back buffer to absorb shock and lessen mechanical damage.

Another objective of the present invention is to provide an improved impact massager with two impact force modules that remedies correctively set spinal joint rotations.

Yet another objective of the present invention is to provide an improved impact massager with no-load protection in which power is cut off under no-load condition.

Still another objective of the present invention is to provide an improved impact massager have good heat dissipation.

Still yet another objective of the present invention is to provide an improved impact massager capable of adjusting the impact depths.

It should first be stated that the present invention may include a chassis with a housing space therein, wherein the chassis is in communication with outside through two openings at one end of the chassis, two impact force modules and a main circuit board are provided inside the housing space, the main circuit board is electrically connected to an operational switch that is disposed on the chassis The improved impact massager is characterized in that each of the impact force modules includes: an heat sink, an electromagnetic component, a cushioning element, a drive component group and a transmission assembly, wherein:

the heat sink is hollow and includes a coupling seat with a hole;

the electromagnetic component is disposed in the heat sink with a through hole passing through the center thereof;

the cushioning element is secured coaxially with the through hole inside the housing space;

the drive component group includes a drive rod capable of reciprocating within the through hole, one end of the drive rod is connected to an impact rod, the outer periphery of the impact rod is sleeved into a shock absorber spring and the impact rod is passed through the hole of the coupling seat, the shock absorber spring is placed between the drive rod and the coupling seat, respectively, the other end of the impact rod is coupled to a fitting that is sleeved into a buffer spring; and the transmission assembly includes an adjustment cylinder partially protruding out of the chassis; a payload stick passing through the adjustment cylinder, one end of the payload stick passing through a constant spring and coupled with an impact joint and an impact head while the other end being sleeved into a magnetic core ring and extending into the adjustment cylinder to abut against the fitting and the buffer spring; a coupler connected to one end of the coupling seat away from the heat sink, an oscillating coil being provided inside the coupler and electrically connected with the main circuit board.

When the oscillating coil and the magnetic core ring are coaxially positioned and displaced with respect to each other, the magnetic core ring does not overlap with the oscillating coil, and no current is generated by the oscillating coil and the main circuit board is in a power-off state, and no power is transmitted from the main circuit board to the electromagnetic component even when the operational switch is actuated, so that motions are inhibited under no-load condition, and the cushioning element absorbs an impact force created when the drive rod is returning to its original position.

In the above structure, the chassis laterally may extend a grip portion on which the operational switch is disposed.

In the above structure, the chassis may comprise two corresponding side cases and a back cover that combines with the two corresponding side cases at one end.

In the above structure, each coupler may abut against the inner periphery of the respective opening of the chassis, and each adjustment cylinder may pass through and extend outside of the respective opening.

In the above structure, a central hole is provided at one end of the adjustment cylinder and a receiving hole with an internal diameter larger than that of the central hole is provided at the other end of the adjustment cylinder, and a convex ring against which the constant spring abuts is annularly provided on a portion of the payload stick extending into to the adjustment cylinder, a step formed at the junction of the central hole and the receiving hole abuts against the constant spring and limits the convex ring, so as to prevent the adjustment cylinder from loosening and rotating during impact exerted by the payload stick.

In the above structure, the grip portion of the chassis may be hollow and contain the main circuit board.

In the above structure, a control panel may be provided on the top of the chassis and electrically connected with the main circuit board.

In the above structure, buffer seats connected to the respective cushioning elements may be provided in the chassis.

In the above structure, a plurality of heat dissipating mounts may be provided on the back cover, and each of the heat dissipating mounts may be provided with a heat dissipater.

BRIEF DESCRIPTION OF THE DRAWINGS

The invention will become more fully understood from the detailed description and the accompanying drawings, which are given for illustration only, and thus are not limitative of the present invention, and wherein.

DETAILED DESCRIPTION OF THE INVENTION

Figure 1:
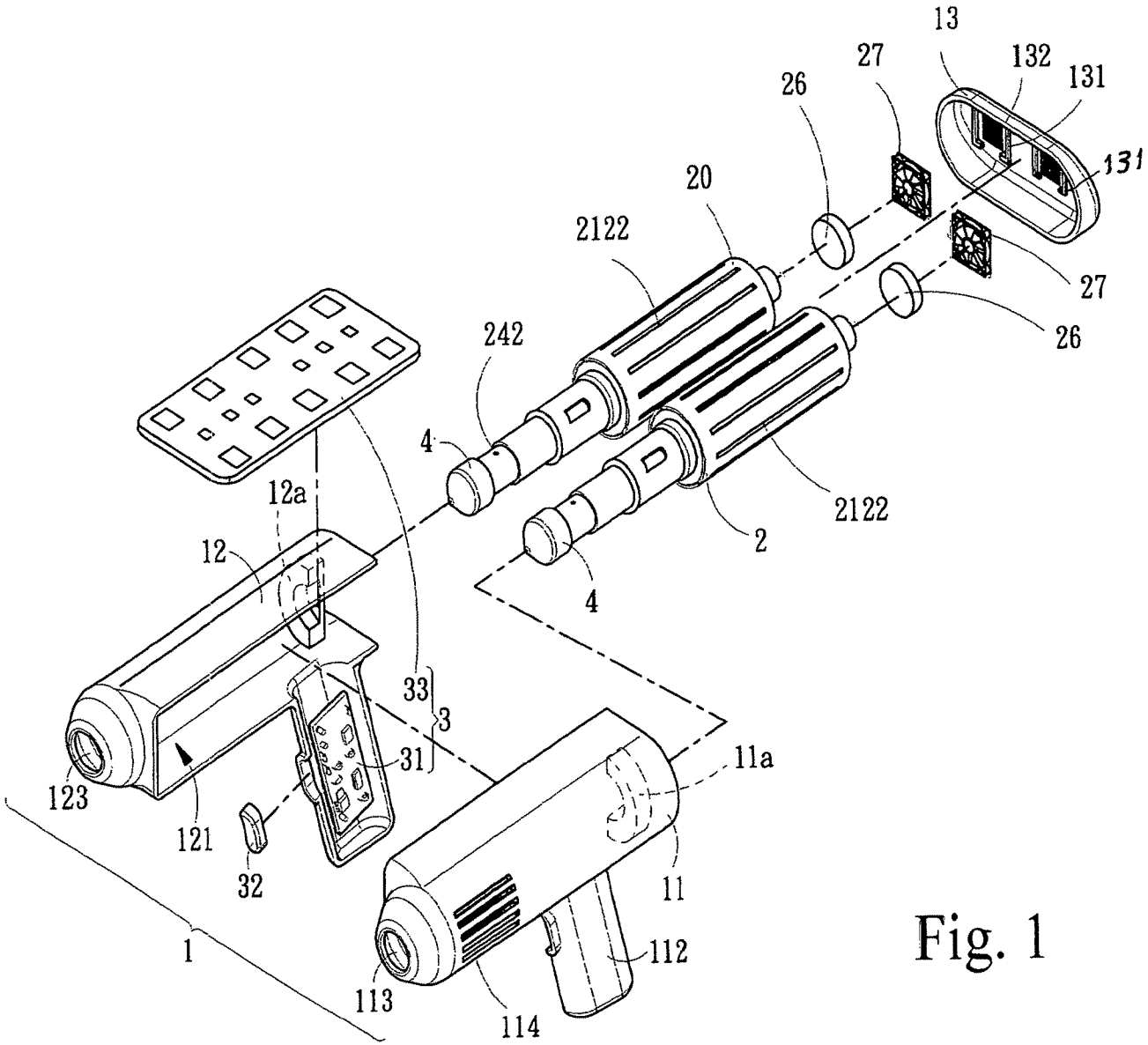
FIG. 1 is an exploded perspective view of an impact massager according to an embodiment of the present invention.
Figure 2:
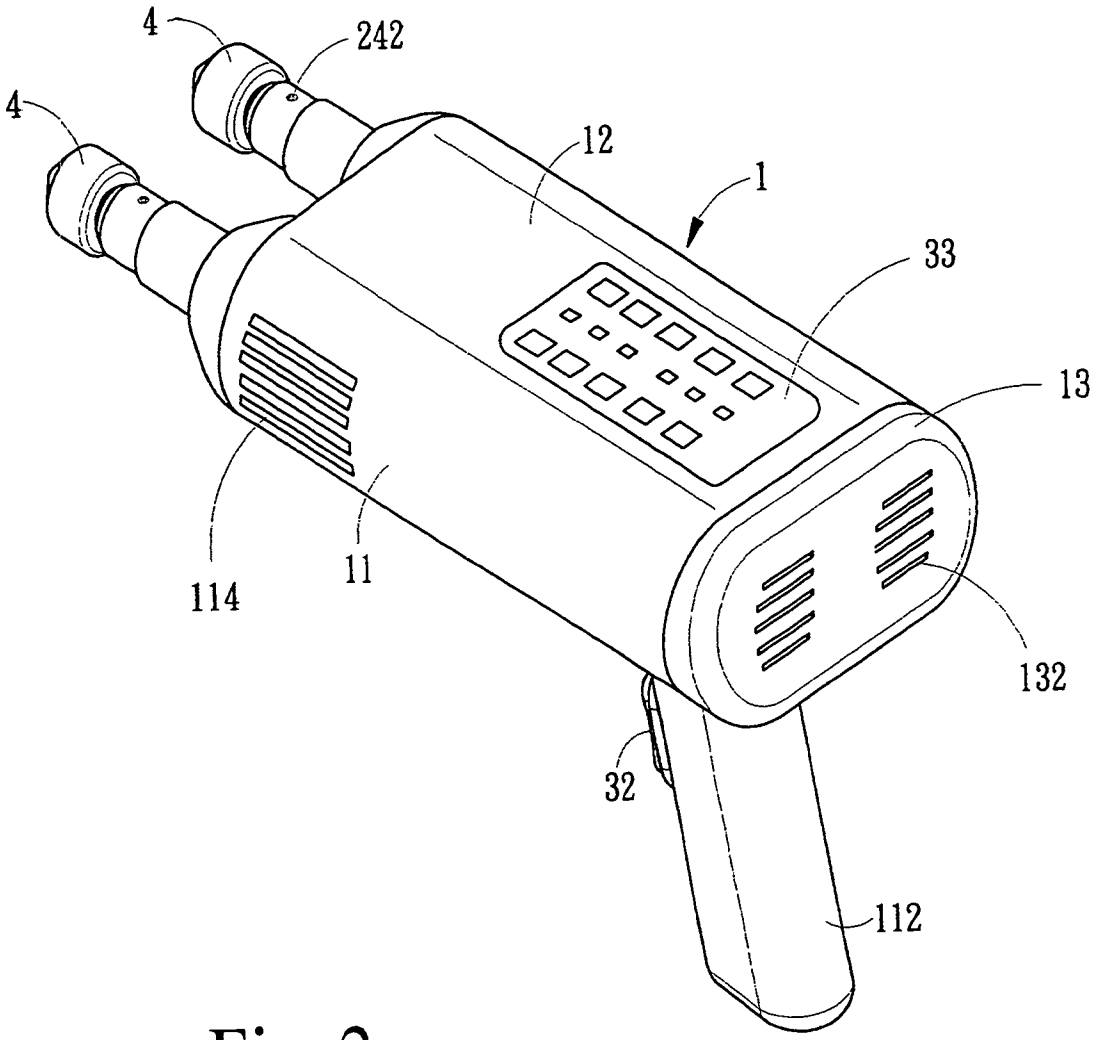
FIG. 2 is a rear view of the impact massager according to an embodiment of the present invention.
Figure 3:
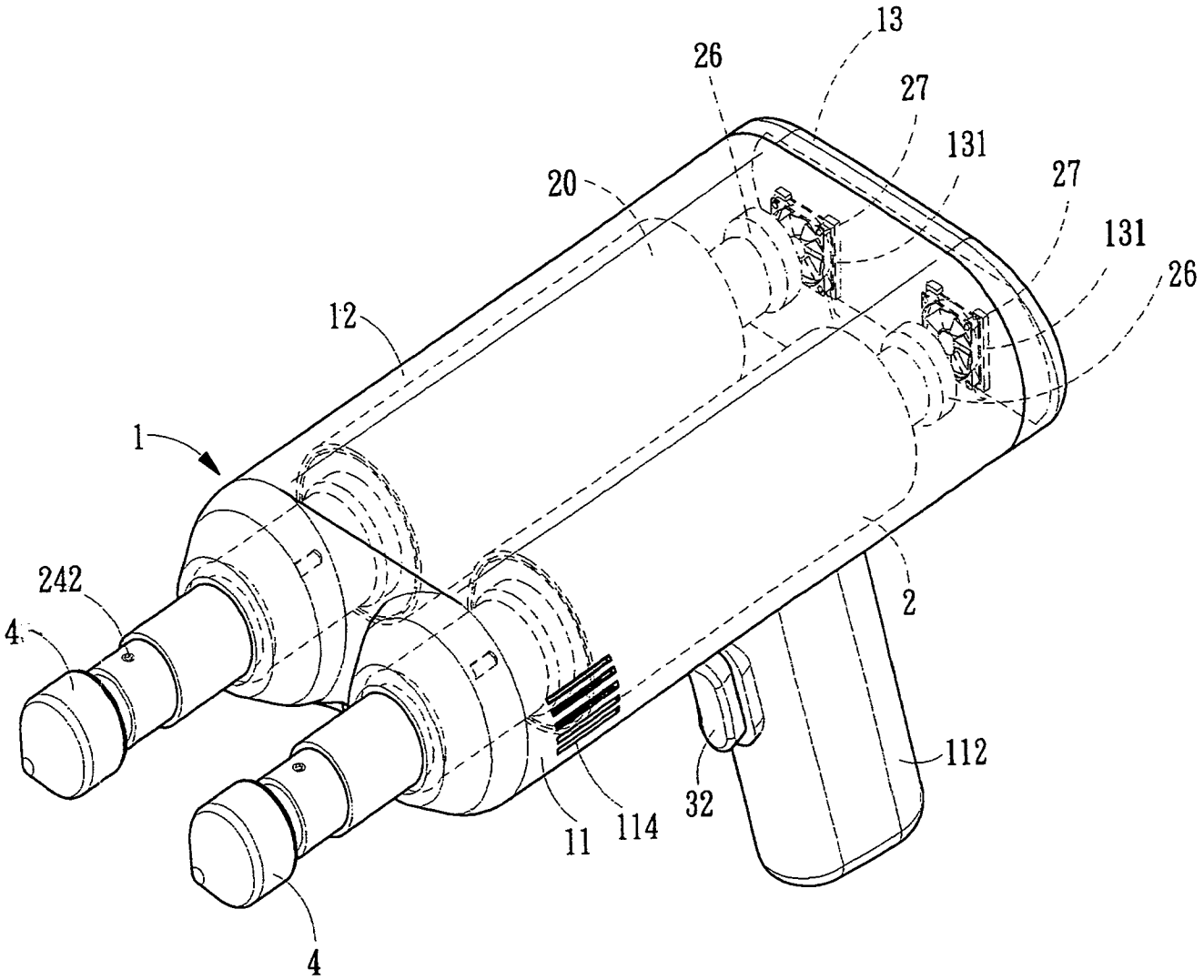
FIG. 3 is a front view of the impact massager according to an embodiment of the present invention.
Figure 4:
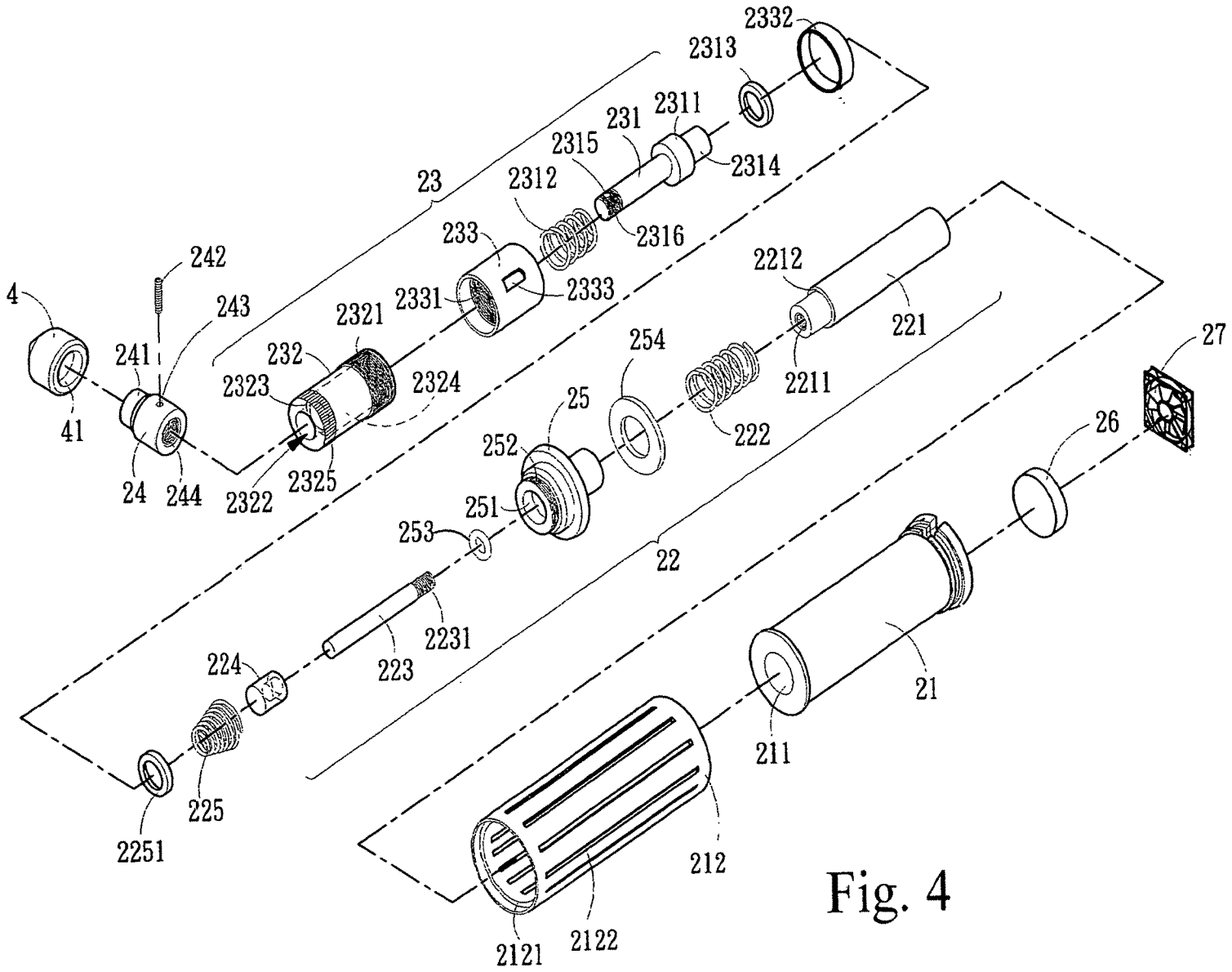
FIG. 4 is an exploded perspective view of an impact force module according to an embodiment of the present invention.

Referring to FIGS. 1-3, embodiments of the present invention include a chassis 1, two impact force modules 2 and 20, a control assembly 3, and two impact heads 4 and 40.

The chassis 1 has two side cases 11 and 12 that combine with each other and a back cover 13 that combines with the side cases 11 and 12 at one end. Buffer seats 11*a* and 12*a* are provided in the two side cases 11 and 12 near the back ends thereof, respectively. A plurality of heat dissipating mounts 131 and air-entry holes 132 are disposed on the back cover 13. A heat dissipater 27 is provided on each of the heat dissipating mounts 131. A housing space 121 is formed between the two side cases 11 and 12. One end of the housing space 121 is connected to the outside through two openings 113 and 123. A hollow grip portion 112 extends from one side of the chassis 1, and exhaust holes 114 are provided on the chassis 1 near the two openings 113 and 123. It should be noted that, in FIG. 1, the exhaust hole on the side case 12 is not shown and labeled due to the angle of view and simplicity of the drawing. Similarly, in FIG. 3, in order to emphasize the heat dissipating mounts 131, the exhaust hole 114 and the heat dissipaters 27 and for clarity of the drawing, the buffer seats 11*a* and 12*a* are omitted. The buffer seats 11*a* and 12*a* can alternatively be found in FIGS. 1, 5 and 7.

The two impact force modules 2 and 20 have the same structure, and are placed in the housing space 121 in parallel. The two impact force modules 2 and 20 partially extends outside of the chassis 1 through the two openings 113 and 112, respectively, and the two impact heads 4 and 40 are coupled to the portions of the two impact force modules 2 and 20 that are outside the chassis 1.

The control assembly 3 includes a main circuit board 31, an operational switch 32, and a control panel 33. The main circuit board 31 can be contained in the grip portion 112 (or the housing space 121) of the chassis 1. The operational switch 32 can be provided at the outer portion of the grip portion 112, providing easy control of the two impact force modules 2 and 20. The control panel 33 is provided at the top of the chassis 1. The main circuit board 31 is electrically connected to the control panel 33, the impact force modules 2 and 20 and the heat dissipaters 27.

Referring to FIGS. 4-7, in one embodiment of the present invention, the impact force module 2 includes an electromagnetic component 21, a drive component group 22, a transmission assembly 23, an impact joint 24 and a cushioning element 26. It should be noted that the impact force module 20 is exactly identical to the impact force module 2, so only the impact force module 2 is used to illustrate an embodiment of the present invention, and the descriptions of the impact force module 20 are thus omitted.

The electromagnetic component 21 can be a coil formed by winding conductors. A through hole 211 is disposed through the center thereof. a heat sink 212 can be provided at the outer periphery of the electromagnetic component 21 if needed. A plurality of heat dissipating holes 2122 are provided on the surface of the heat sink 212. It should be noted that, in FIG. 3, for conciseness of the drawing, the heat dissipating holes 2122 are not shown. An annular stop groove 2121 is provided around the inner periphery of one end of the heat sink 212. The purpose of the annular stop groove 2121 is to limit the coupling seat 25 inserted into the heat sink 212. A through hole 251 is provided through the center of the coupling seat 25. An outer thread 252 is annularly provided at one end of the outer periphery of the through hole 251. A gasket 253 is provided at the outer thread 252 of the coupling seat 25, while a washer 254 is provided at the other end of the coupling seat 25. The washer 254 sits against the end face of the electromagnetic component 21.

The drive component group 22 includes a drive rod 221, a shock absorber spring 222, an impact rod 223 and a fitting 224. One end of the drive rod 221 may slide into the through hole 211 of the electromagnetic component 21. The impact rod 223 is passed through the through hole 251 of the coupling seat 25. An outer thread 2231 on one end of the impact rod 223 is engaged with an internal thread 2211 on one end of the drive rod 221, while the other end of the impact rod 223 is coupled to the fitting 224. The outer periphery of the impact rod 223 is surrounded by a buffer spring 225. One end of the buffer spring 225 with the larger diameter abuts against the coupling seat 25, while the other end having the smaller diameter abuts against a washer 2251, the drive rod 221 and the coupling seat 25. Moreover, the outer periphery of the impact rod 223 is surrounded by the shock absorber spring 222, one end of the shock absorber spring 222 abuts against a stop ring 2212 of the drive rod 221, while the other end sits against the washer 254 of the coupling seat 25. The elastic force created by the shock absorber spring 222 under pressure will allow the drive rod 221 to return to its original position.

Figure 7:
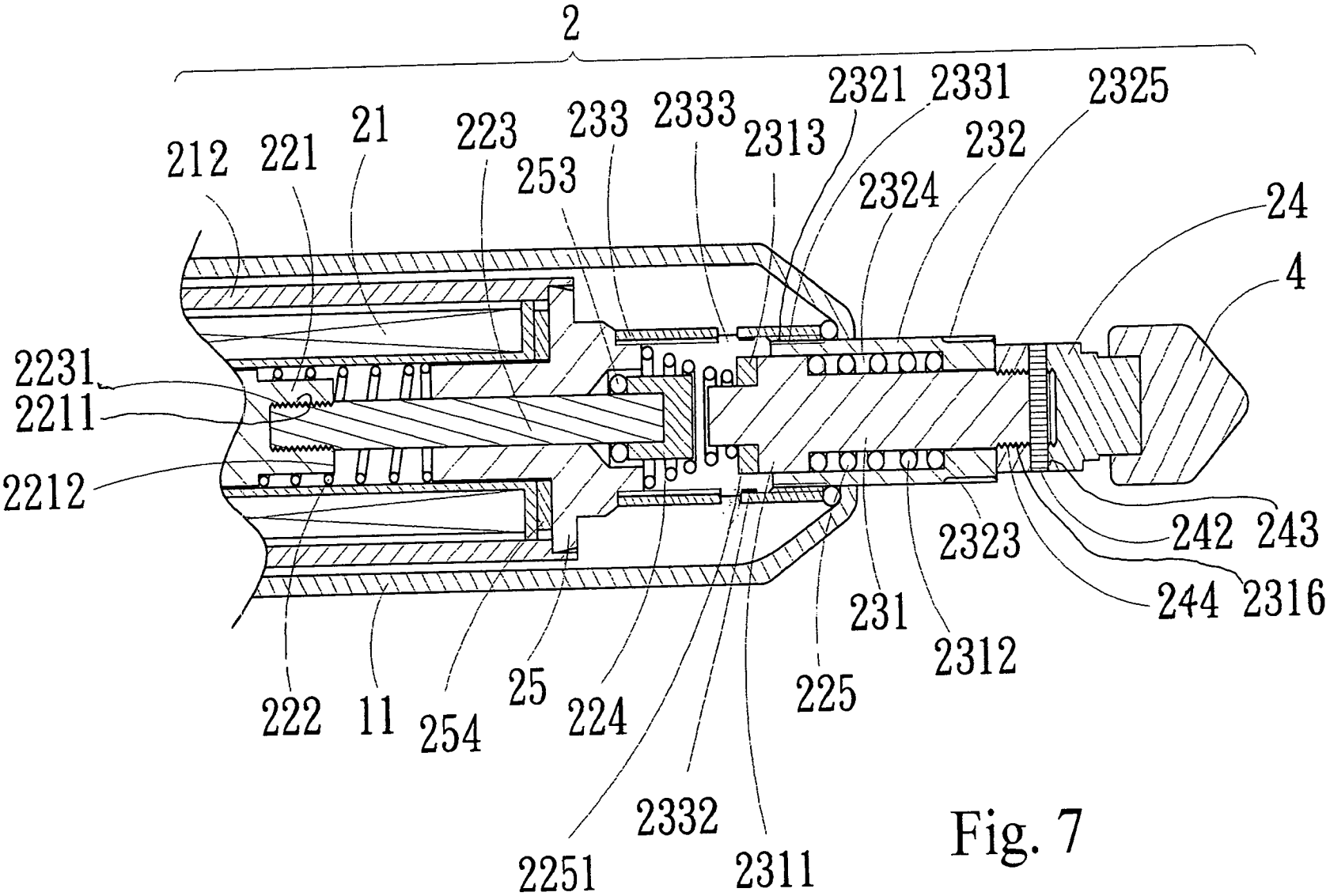
FIG. 7 is a partially enlarged view of FIG. 5.

The transmission assembly 23 includes a payload stick 231, an adjustment cylinder 232 and a coupler 233. The payload stick 231 is provided with a convex ring 2311, and a coupling portion 2314 extends from the same end as the convex ring 2311, and a bolt hole 2315 is provided at the other end of the payload stick 231. The coupler 233 includes an internal thread 233 formed at one end of the coupler 233, And a hole window 2333 provided on the surface of the coupler 233. An oscillating coil 2332 is provided in the coupler 233, adjacent to the internal threads 2331 (FIG. 7). The adjustment cylinder 232 includes an external thread 2321 at one end, such that the external thread 2321 engages with the internal thread 2331 when the adjustment cylinder 232 is sleeved into the coupler 233, and the other end of the adjustment cylinder 232 extends outwards from the coupler 233. The internal thread 2331 also engages with the external thread 252 of the coupling seat 25, so that the coupler 233 is connected with the coupling seat 25. A central hole 2322 with a smaller internal diameter is formed at one end of the adjustment cylinder 232, while a receiving hole 2324 with a larger internal diameter is formed at the other end of the adjustment cylinder 232 for receiving a constant spring 2312. The payload stick 231 is sleeved into the constant spring 2312 before being passed through a step 2323 formed at the junction of the central hole 2322 and the receiving hole 2324 of the adjustment cylinder 232. A magnetic core ring 2313 is fitted onto the coupling portion 2314 of the payload stick 231 to fit tightly with the convex ring 2311, whereas the constant spring 2312 is fitted onto the other end of the payload stick 231 and abuts against the step 2323. The magnetic core ring 2313 and the oscillating coil 2332 in the coupler 233 are co-axially positioned and displaced with respect to each other. The convex ring 2311 is limited by the step 2323 via the constant spring 2312, resulting in the payload stick 231 pressing firmly against the adjustment cylinder 232 through the constant spring 2312 that abuts against the step 2323 and the convex ring 2311 on either side thereof, such that the adjustment cylinder 232 can be prevented from loosening and in turn rotating when being impacted by the payload stick 231.

The impact joint 24 includes a bolt hole 243 having an internal thread 244, wherein a fixing bolt 242 can be tightened into the bolt holes 243 and 2315 to engage the internal thread 244 of the impact joint 24 with an external thread 2316 at one end of the payload stick 231. In one embodiment of the present invention, the impact head 4 has a bore 41, and the impact joint 24 has a corresponding coupling portion 241 to fit snuggly into the bore 41. This allows the impact joint 24 to be combined with impact heads 4 of different shapes based on the user's requirements.

During the assembly process, one end of the coupler 233 can be placed against the inner periphery of the opening 113 of the chassis 1 while allowing the adjustment cylinder 232 to pass through the opening 113 to extend outwards. Meanwhile, the drive rod 231 passes through the center hole 2322 to project out of the chassis 1 and is combined with the impact head 4 through the impact joint 24. During its operation, the electromagnetic component 21, when energized, will produce an electromagnetic force to drive the drive rod 221 to reciprocate back and forth with the aid of the shock absorber spring 222 within the through hole 211. The drive rod 221 in turn causes the fitting 224 to also reciprocate back and forth via the impact rod 223. The fitting 224 then, in turn, impacts the payload stick 231 with the buffer spring 225 and the washer 2251 acting as the buffer. The payload stick 231 subsequently drives the impact head 4 via the impact joint 24. This will allow the massager to provide vibrational impact on a human's body.

Figure 6:
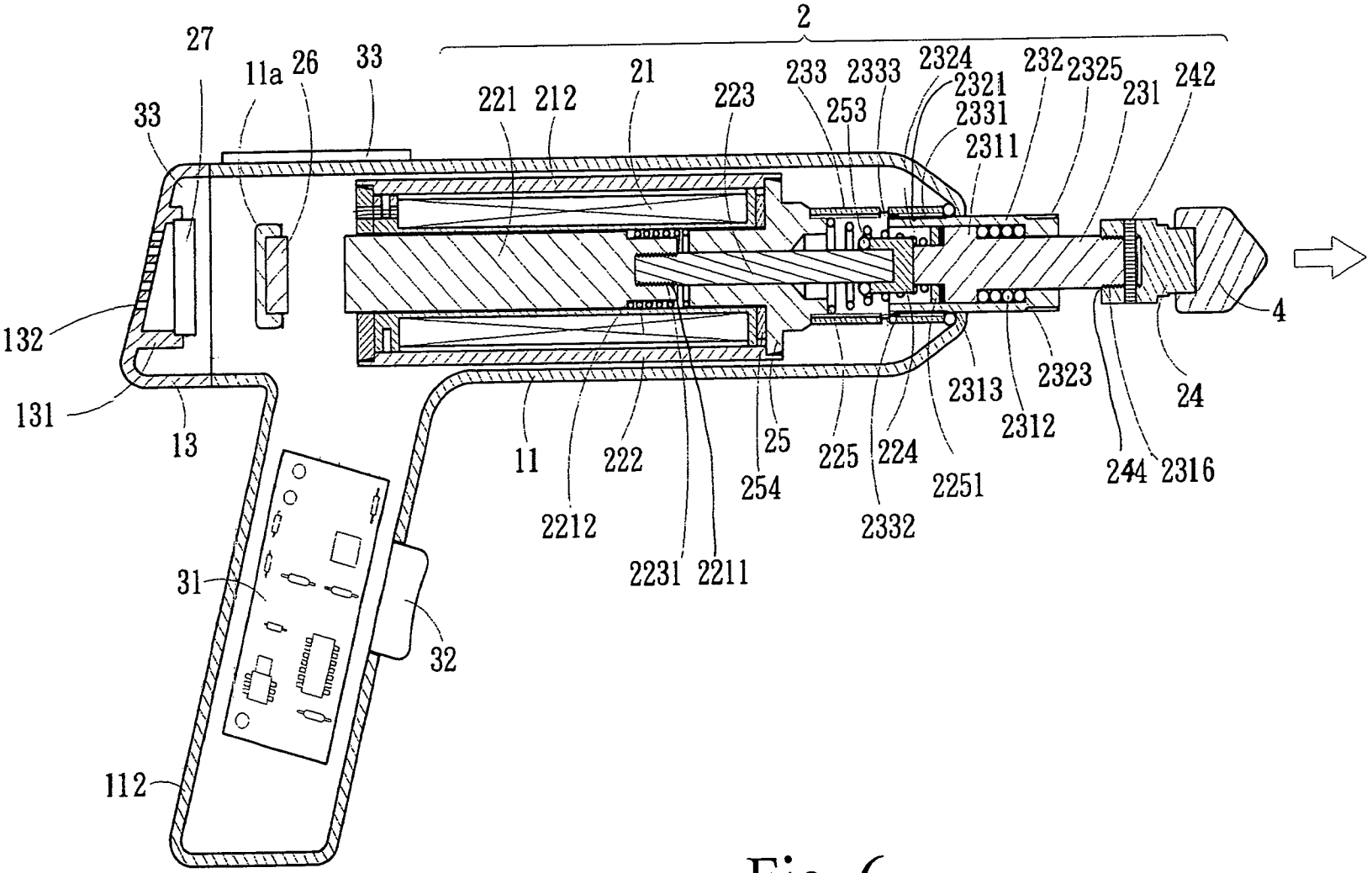
FIG. 6 is a cross-sectional view of the impact massager in a second state according to an embodiment of the present invention.

In practice, the control panel 33 can be utilized in the above structure to set different adjustments by forming different electric connections, for example, to set the impact forces and frequencies of the impact force modules 2 and 20 and the like. This will allow the main circuit board 3 to control each of the two impact force modules 2 and 20 through the control panel 33, such that different forces and frequencies of regular linear-motion impacts can be delivered. The operational switch 32 can control the main circuit board 31. Programmable instructions can be set based on inputs on the control panel 33 for activating the impact force modules 2 and 20. When the impact head 4 of the present invention is not firmly pressed against a user's body, as shown in FIG. 6, the shock absorber spring 222 and the buffer spring 225 are in elastic equilibrium, and the magnetic core ring 2313 on the payload stick 231 is displaced from the oscillating coil 2332 in the coupler 233, that is, the magnetic core ring 2313 is not inserted in the oscillating coil 2332, so the oscillating coil 2332 will not generate a current. Meanwhile, a switch module (not shown, and the principle and structure of which are not explained as they are not the technical features of the present invention) on the main circuit board 31, such as a CPU or a chip, remains in a power-off state, so there will be no current passing through the main circuit board 31. If the operational switch 32 is accidently pressed, the main circuit board 31 will not transmit power to the impact force modules 2 and 20, resulting in no motions under no-load condition, thereby achieving a mechanical structure that offers no-load protection.

Figure 5:
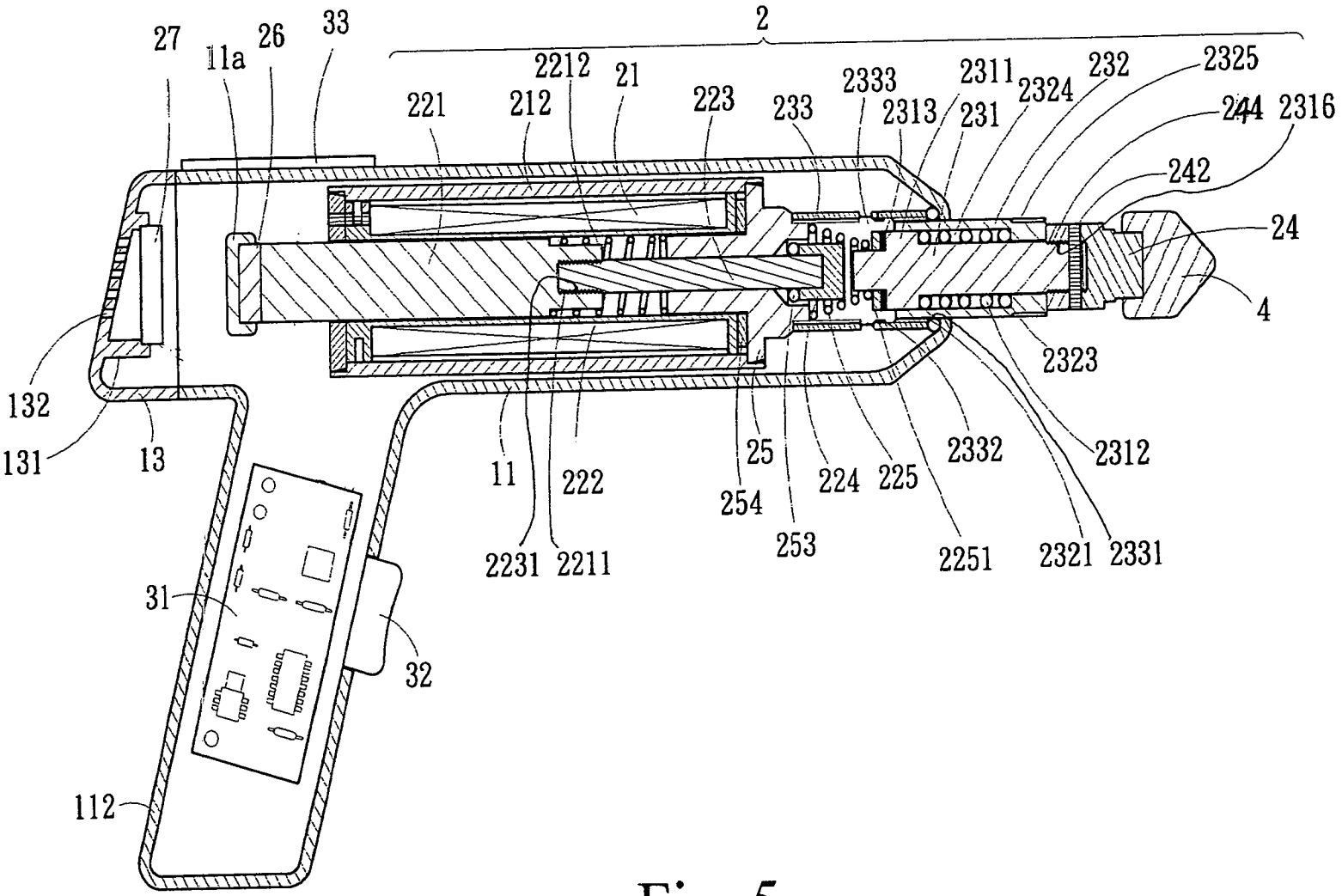
FIG. 5 is a cross-sectional view of the impact massager in a first state according to an embodiment of the present invention.

As shown in FIG. 5, when the impact head 4 is firmly pressed against the user's body, the shock absorber spring 222 and the buffer spring 225 are pushed back by the impact head 4 into compression. At the same time, the magnetic core ring 2313 on the payload stick 231 moves into the oscillating coil 2332 of the coupler 233, causing the oscillating coil 2332 to generate a current (the techniques related to the conversion of magnetic energy to electrical energy are not the technical features of the present invention and well known in the art by Faraday's Law etc., so they will not be further explained). Once the switch module on the main circuit board 31 receives the current generated by the oscillating coil 2332, the main circuit board 31 energizes the electromagnetic component 21, which then generates a magnetic field that results in the drive rod 221 being pushed forwards. Meanwhile, the drive rod 221 pushes the fitting 224 forward via the impact rod 223. The fitting 224 in turn impacts the payload stick 231, which then transmits the impact force to bring the impact head 4 forwards via the impact joint 24, creating an impact massage force. When the operational switch 32 is continuously pressed while the impact head 4 is firmly pressed against the user's body, continuous massage motions can be enabled. Once the body is not in contact with the impact head 4, the magnetic core ring 2313 on the payload stick 231 and the oscillating coil 2332 in the coupler 233 are displaced in relation to each other, which means the electromagnetic component 21 is de-energized and there will be no massage motions. As a result, the drive rod 221 is now pushed backwards to return to its original position by the elastic force of the shock absorber spring 222. When the drive rod 221 is at its original position, the magnetic core ring 2313 on the payload stick 231 and the oscillating coil 2332 of the coupler 233 are in overlap once again, thus the same actions described above are repeated. This achieves reciprocating motions of the impact force modules 2 and 20 and the impact head 4. When the impact force modules 2 and 20 are in actions, the cushioning elements 26 are capable of absorbing the impact force created as a result of the drive rods 221 returning to their original positions, thus providing a shock-absorbing structure.

When the adjustment cylinder 232 is rotated, the external thread 2321 of the adjustment cylinder 232 couples with the internal thread 2331 of the coupler 233, such that the adjustment cylinder 232 is able to travel further into or out of the coupler 233. When the adjustment cylinder 232 is rotated in an anti-clockwise direction, the constant spring 2312 relaxes and naturally the buffer springs 225 extends to widen the gap between the payload stick 231 and the fitting 224. On the other hand, when the adjustment cylinder 232 is rotated in a clockwise direction, the constant spring 2312 compresses, which forces the buffer springs 225 to also compress, reducing the gap between the payload stick 231 and the fitting 224. As such, a structure with adjustable impact depths for an impact target area can be achieved. The impact power modules 2 and 20 can adjust the sizes of the gaps between their respective coupling portions 2314 and the fittings 224 simultaneously or independently.

When the present invention is in use, the heat dissipaters 27 can be activated by a temperature sensor provided on the main circuit board 31 sensing that the temperature in the chassis 1 has gone too high, the heat dissipaters 27 draw outside air into the housing space 121 of the chassis 1 through the air-entry holes 132 of the back cover 13, the air flows through the heat dissipating holes 2122 on the heat sinks 212, so that the heat created by the electromagnetic components 21 can be conducted outside along with the air and expelled through the exhaust holes 114 of the chassis 1, thereby providing a structure with good heat dissipation.

Figure 8:
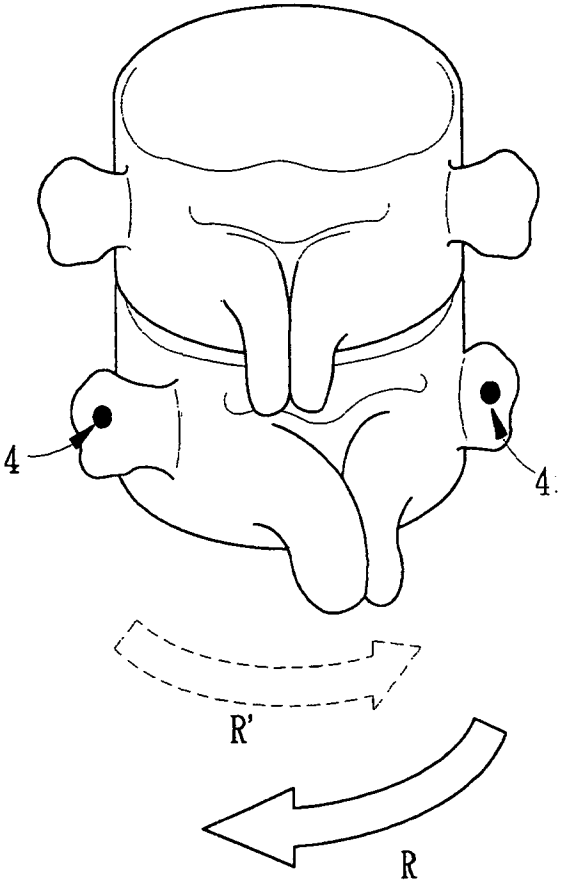
FIG. 8 is a schematic diagram illustrating the right-rotation symptom of the lower lumbar for which the impact massager according to an embodiment of the present invention is applied.

FIG. 8 provides an illustrative view of the right-rotation symbol (as indicated by the direction of R') of a human body's lower lumbar for which the structure of the present invention can be applied. Additional attention is also directed to FIG. 1. In this circumstance, the main circuit board 31 can be configured via the control panel 33, such that the impact force module 2 will have regular linear-motion impact with "medium-strong" force and a frequency of 12 times per second. The main circuit board 31 can be additionally configured via the control panel 33 to set regular linear-motion impact of the impact force module 20 to have "weak" force and a frequency of 2 times per second. Then, a user may place the impact head 4 of the impact force module 2 against the left side of the fourth lumbar vertebrae, while placing the impact head 40 of the impact force module 20 against the right side of the fourth lumbar vertebrae. By pressing the operational switch 32, the two impact force modules 2 and 20 will be activated, and, in a few seconds, the right-rotation symbol may be alleviated by returning the fourth lumbar vertebrae to its horizontal normal position. The is due to the two impact force modules 2 and 20 being able to provide regular linear-motion impacts with different forces and frequencies, thereby producing a left-restoring "loosening" force in the direction as depicted by the solid arrow R in FIG. 8. Buffering (or protection) effect can also be produced because the impact force module 20 applies a smaller force than the impact force module 2, and loosening effect can be produced because the impact force module 20 has a smaller frequency than the impact force module 2.

Figure 9:
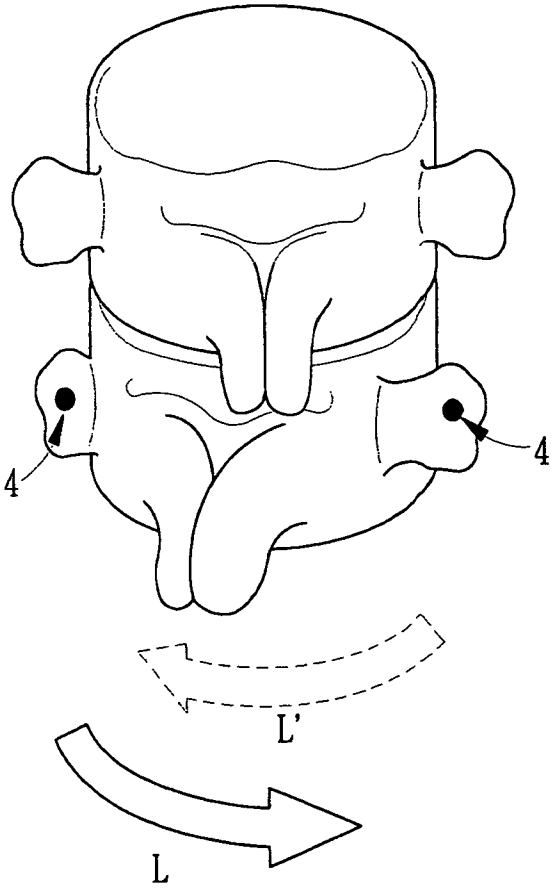
FIG. 9 is a schematic diagram illustrating the left-rotation symptom of the lower lumbar for which the impact massager according to an embodiment of the present invention is applied.

FIG. 9 provides an illustrative view of the left-rotation symbol (as indicated by the direction of L' in FIG. 9) of the lower lumbar of a human body's lower lumbar for which the structure of the present invention can be applied. Additional attention is also directed to FIG. 1. In this circumstance, the main circuit board 31 is configured via the control panel 33, such that the impact force module 2 will have regular linear-motion impact with "weak" force and a frequency of 2 times per second. The main circuit board 31 is additionally configured, via the control panel 33, to set regular linear-motion impact of the impact force module 20 to have "medium-strong" force and a frequency of 12 times per second. Then, a user may place the impact head 4 of the impact force module 2 against the left side of the fourth lumbar vertebrae, while placing the impact head 40 of the impact force module 20 against the right side of the fourth lumbar vertebrae. By pressing the operational switch 32, the two impact force modules 2 and 20 will be activated, and, in a few seconds, as depicted by the solid arrow L in FIG. 9, the left-rotation symbol may be alleviated by returning the fourth lumbar vertebrae to its horizontal normal position.

As can be appreciated from the descriptions with respect to FIGS. 1, 8 and 9, the actions (e.g. the order of different impact modes, such as synchronous impacts, asynchronous impacts, a single impact) or the impact frequencies and forces of the impact power modules 2 and 20 can be adjusted by configuring the main circuit board 31 via the control panel 33 accordingly.

Accordingly, the massager in accordance with the present invention is indeed novel and possesses an inventiveness step. Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all variations, modifications, changes and equivalents that fall within the true scope of the invention.

What is claimed is:

1. An improved massager comprising a chassis with a housing space therein, wherein the chassis is in communication with outside through two openings at one end of the chassis, two impact force modules and a main circuit board are provided inside the housing space, the main circuit board is electrically connected to an operational switch that is disposed on the chassis, each of the impact force modules including:

a hollow heat sink including a coupling seat with a hole;

an electromagnetic component disposed in the heat sink with a through hole passing through the center thereof;

a cushioning element secured coaxially with the through hole inside the housing space;

a drive component group including a drive rod capable of reciprocating within the through hole, one end of the drive rod being connected to an impact rod, an outer periphery of the impact rod being sleeved into a shock absorber spring and the impact rod being passed through the hole of a coupling seat, two ends of the shock absorber spring abutting against the drive rod and the coupling seat; respectively, one end of the impact rod being coupled to a fitting that is sleeved into a buffer spring;

a transmission assembly including:

an adjustment cylinder partially protruding out of the chassis, and a payload stick with one end passing through a constant spring and coupled with an impact joint and an impact head and the other end being sleeved into a magnetic core ring and extending into the adjustment cylinder to abut against the fitting and the buffer spring, and a coupler connected to one end of the coupling seat away from the heat sink with an oscillating coil provided inside the coupler and electrically connected to the main circuit board; and wherein when the oscillating coil and the magnetic core ring are separated from each other, the magnetic core ring does not overlap with the oscillating coil, and no current is generated by the oscillating coil and the main circuit board is in a power-off state, and no power is transmitted from the main circuit board to the electromagnetic component even when the operational switch is actuated, so that motions are inhibited under no-load condition, and wherein the cushioning element absorbs an impact force created when the drive rod is returning to its original position.

2. The improved impact massager of claim 1, wherein the chassis laterally extends a grip portion on which the operational switch is disposed.

3. The improved impact massager of claim 2, wherein the grip portion of the chassis is hollow and contains the main circuit board.

4. The improved impact massager of claim 2, wherein a control panel is provided on a top of the chassis and electrically connected with the main circuit board.

5. The improved impact massager of claim 1, wherein the chassis comprises two corresponding side cases and a back cover that combines with the two corresponding side cases.

6. The improved impact massager of claim 5, wherein a plurality of the heat dissipating mounts are provided on the back cover, and each of the heat dissipating mounts is provided with a heat dissipater.

7. The improved impact massager of claim 1, wherein each coupler abuts against an inner periphery of the respective opening of the chassis, and each adjustment cylinder passes through and extends outside of the respective opening.

8. The improved impact massager of claim 1, wherein a central hole with a smaller internal diameter is provided at one end of the adjustment cylinder and a receiving hole with a larger internal diameter, larger than said central hole, is provided at the other end of the adjustment cylinder, and a convex ring against which the constant spring abuts is annularly provided on a portion of the payload stick extending into the adjustment cylinder, a step formed at a junction of the central hole and the receiving hole abuts against the constant spring and limits the convex ring, so as to prevent the adjustment cylinder from loosening and rotating during impact.

9. The improved impact massager of claim 1, wherein buffer seats connected to the respective cushioning elements are provided in the chassis.

10. The improved impact massager of claim 1, wherein an internal thread is provided at one end of the coupler and an external thread is provided at one end of the adjustment cylinder, the adjustment cylinder is inserted into the coupler by engaging the external thread with the internal thread, the adjustment cylinder is allowed to travel into or out of the coupler when the adjustment cylinder is being rotated, the payload stick is moved along with the adjustment cylinder, such that a size of a gap between the payload stick and the fitting is adjusted to achieve a structure with adjustable impact depths for a target area.

* * * * *